US005954411A

United States Patent [19]

Katz

[11] Patent Number: 5,954,411

[45] Date of Patent: Sep. 21, 1999

[54] TWO-STEPPED CABINET

[75] Inventor: Howard S. Katz, Riegelsville, Pa.

[73] Assignee: Robern, Inc., A Pennsylvania Corporation, Britsol, Pa.

[21] Appl. No.: 09/012,058

[22] Filed: Jan. 22, 1998

[51] Int. Cl.[6] ..... A47B 67/02

[52] U.S. Cl. ..... 312/242; 312/224

[58] Field of Search ..... 312/242, 204, 312/245, 224, 227

[56] References Cited

U.S. PATENT DOCUMENTS

| | | | |
|---|---|---|---|
| 1,442,588 | 1/1923 | Tompkins . | |
| 2,193,372 | 3/1940 | Miller | 312/224 X |
| 2,678,252 | 5/1954 | Swearingen . | |
| 2,911,275 | 11/1959 | Wise | 312/242 |
| 3,140,134 | 7/1964 | Nairn | 312/204 |
| 3,807,824 | 4/1974 | Hayes | 312/224 X |
| 5,368,378 | 11/1994 | Curtis | 312/242 X |
| 5,401,094 | 3/1995 | Walsten | 312/242 |
| 5,484,196 | 1/1996 | Kim | 312/242 |

FOREIGN PATENT DOCUMENTS

| | | | |
|---|---|---|---|
| 361378 | 5/1962 | Switzerland | 312/242 |

*Primary Examiner*—Peter M. Cuomo
*Assistant Examiner*—James O. Hansen
*Attorney, Agent, or Firm*—Panitch Schwarze Jacobs & Nadel, P.C.

[57] ABSTRACT

A modular, one piece two-stepped cabinet which provides expanded storage capacity is shown. The cabinet is intended for use in the spacing between two adjacent studs in a wall. The cabinet comprises a first-step portion with lateral sides spaced to fit within a cabinet space, upper and lower sides and a rear wall. A second-step portion, integrally formed with the first, comprises lateral sides, upper and lower sides which are spaced further apart than those of the first portion, and a rear wall extending inward and joining the sides of the first portion at their forward edges. Shelves, which may be re-positionable, are provided and a mirror is provided on the rear wall of the first-step portion. In addition, a removable, re-positionable convenience cup is provided.

11 Claims, 2 Drawing Sheets

10
12
14
16
18
20
22
24
24a
24b
26
26a
26b
28
28a
28b
30
30a
30b
32
34
36
36a
36b
38
38a
38b
40
40b
42
42a
42b
44
46
46a
48
50
52
54
54a
56
58
60
60a
60b
60c
62
64
66
68
70
72
74
76
78
82
84
86
88
90
92
94

TWO-STEPPED CABINET

BACKGROUND OF THE INVENTION

The present invention relates generally to bathroom cabinets and, more particularly to a two-stepped bathroom cabinet which provides increased storage.

In most private residences, including homes and apartments, a cabinet is typically provided on a wall of each bathroom for the purpose of holding various medicines and personal items, such as shaving supplies, first aid supplies, oral and other personal hygiene items, and the like. Typically, the door of the cabinet is provided with a mirrored outer surface and the cabinet is positioned over or along side of a sink. In most installations, the cabinet is intended to occupy what would otherwise be dead space within a bathroom wall, and is typically a standard size, with a width intended to fit between two upright standardly spaced wall studs.

While such prior art cabinets include shelves generally as deep as the thickness of the wall, the width of such cabinets is generally limited to the distance between two upright wall studs, typically about fourteen inches. While many of the personal items need the space provided, smaller items, such as over-the-counter medicine bottles and prescription drug containers, tend to be pushed to the rear and become hidden behind other items. It is not unusual to "lose" such smaller items where they cannot be seen. Although some such cabinets employ doors which are larger then the outside dimensions of the cabinet, the doors are hinged to one side of the cabinet.

Another storage possibility is a cabinet which is flush mounted against the outer surface of a wall. Such cabinets are typically higher and wider than cabinets mounted between the wall studs, but are seldom very deep, as any substantial depth to the cabinet is taken from the room space. Such cabinets provide an advantage in more conveniently storing and displaying smaller items without them appearing "lost," but are limited in the size of the items which can accommodate due to the limited depth. Larger (deeper) items must be stored elsewhere.

Others have suggested a combination of both cabinet styles. To date, however, such combinations have been chiefly for retrofit installations where a first, deeper cabinet is intended for use within an existing cabinet space cut into a wall, and a second flush mount cabinet is intended to surround the first cabinet. Typically, the two cabinets of such combination cabinet design are initially completely independent of each other, such that the second cabinet may be positioned independently of the first cabinet, often compromising the additional storage space which could be provided. Further, as separate units, the manufacture of the two cabinets is expensive, and installation is difficult and time consuming, which has added to the overall cost.

It would be advantageous to provide a modular, two-stepped cabinet which could provide both shallow and deep storage areas, would be applicable to both new and retrofit installations, and would be significantly less expensive and more convenient both to manufacture and install.

BRIEF SUMMARY OF THE INVENTION

Briefly stated, the present invention comprises a modular, two-stepped cabinet providing expanded storage capacity for use in a cabinet space in a wall. The cabinet space is defined by a first dimension generally equal to the spacing between two adjacent studs in the wall, and a second dimension. The two-stepped cabinet is formed of a unitary body comprising a first-step cabinet portion which includes first and second lateral sides which are spaced apart by a distance generally corresponding to the first dimension, each of the first and second lateral sides of the first-step cabinet portion having a forward edge and a rearward edge. The first-step cabinet portion further includes upper and lower sides which are spaced apart by a distance generally corresponding to the second dimension, each of the upper and lower sides of the first-step cabinet portion having a forward edge and a rearward edge. In addition, the first-step cabinet portion includes a rear wall joining the rearward edges of the first and second lateral sides and the upper and lower sides of the first-step cabinet portion. The unitary body further comprises a second-step cabinet portion. The second-step cabinet which includes first and second lateral sides which are spaced apart by a distance greater than the first dimension, each of the first and second lateral sides of the second-step cabinet portion having a forward edge and a rearward edge. The second-step cabinet portion further includes upper and lower sides which are spaced apart by a distance greater than the second dimension, each of the upper and lower sides of the second-step cabinet portion having a forward edge and a rearward edge. The second-step cabinet portion further includes a rear wall joining the rearward edges of the first and second lateral sides and the rearward edges of the upper and lower sides of the second-step cabinet portion. The rear wall of the second-step cabinet portion has an opening extending therethrough, the opening having a width generally corresponding to the first dimension, and a height generally corresponding to the second dimension, the rear wall of the second-step cabinet portion being integrally formed with the forward edges of the first and second lateral sides and the upper and lower sides of the first-step cabinet portion. Finally, the forward edges of the first and second lateral sides and the forward edges of the upper and lower sides of the second-step cabinet portion establish a forward opening to the modular two-stepped cabinet.

A further aspect of the present invention is a convenience cup for holding articles within a cabinet, the cabinet being provided with an integral support permitting attachment of the cup. The convenience cup comprises a body portion including a generally cylindrical wall, at least a portion of which is generally flattened, a closed bottom portion, and an open top portion which combine to define a hollow interior portion, generally circular in cross-section, and having a depth suitable for holding articles. The convenience cup further comprises an attachment member for the demountable attachment of the convenience cup to the integral support of the cabinet.

BRIEF DESCRIPTION OF THE SEVERAL VIEWS OF THE DRAWINGS

The foregoing summary, as well as the following detailed description of a preferred embodiment of the invention, will be better understood when read in conjunction with the appended drawings. For the purpose of illustrating the invention, there is shown in the drawings an embodiment which is presently preferred, it being understood, however, that the invention is not limited to the specific methods and instrumentalities disclosed. In the drawings.

DETAILED DESCRIPTION OF THE INVENTION

Figure 1:
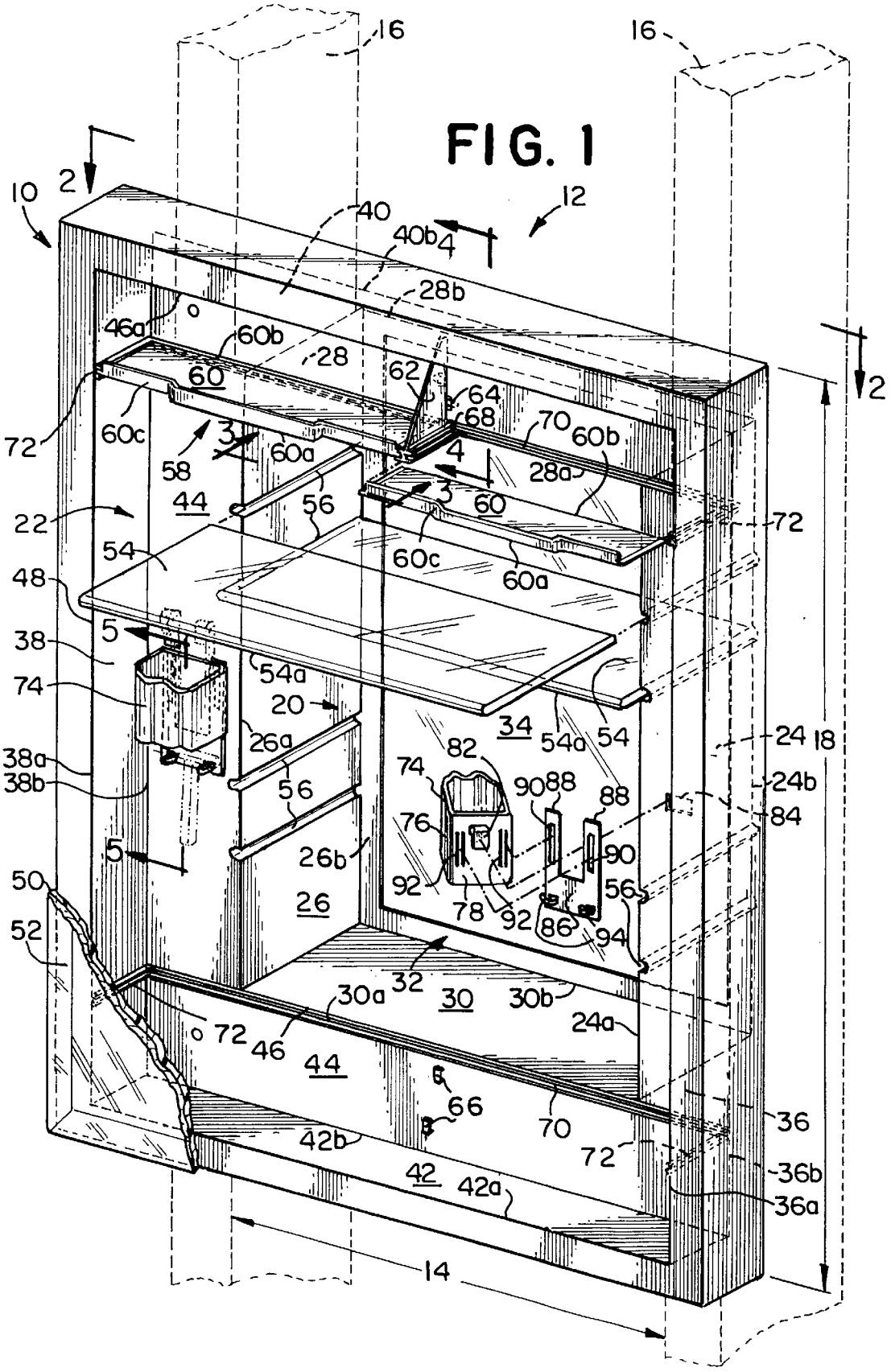
FIG. 1 is a perspective view, partially broken away and partially exploded, of a two-stepped cabinet in accordance with a preferred embodiment of the present invention.

Certain terminology is used in the following description for convenience only and is not limiting. The words "right," "left," "lower" and "upper" designate directions in the drawings to which reference is made. The words "inward," "inwardly," "outward" and "outwardly" refer to directions toward and away from, respectively, the geometric center of the two-stepped cabinet and designated parts thereof. The terminology includes the words above specifically mentioned, derivatives thereof and words of similar import.

Referring to the drawings in detail, wherein like numerals indicate like elements throughout, there is shown in FIG. 1 a perspective view of the unitary body of a two-stepped cabinet 10 in accordance with a preferred embodiment of the present invention. The two-stepped cabinet 10 is intended to provide expanded storage capacity, and is intended for use in a cabinet space 12 within a wall, as illustrated in phantom. Such a cabinet space 12 is defined by a width or first dimension 14 generally equal to the spacing between two adjacent studs 16 in the wall, typically about fourteen inches in a facility in which the studs 16 are spaced sixteen inches on center, and a length or second dimension 18, which is typically in the range of from eighteen to twenty-four inches depending upon the particular application. It should be understood that the first dimension or width 14 and the second dimension or height 18 of the cabinet space 12 and/or the cabinet 10 may vary from the illustrated dimensions in particular applications.

The two-stepped cabinet 10 is formed of a generally unitary body comprising a first-step cabinet portion 20 and a second-step cabinet portion 22. The first-step cabinet portion 20 includes a first lateral side 24 and a second, opposite lateral side 26, the lateral sides 24, 26 being generally parallel to each other and spaced apart by a distance generally corresponding to the first dimension 14. The first lateral side 24 and the second lateral side 26 of the first-step cabinet portion 20 each have a forward edge 24*a*, 26*a* and a generally parallel rearward edge 24*b*, 26*b*.

The first-step cabinet portion 20 further includes an upper side 28 and a lower side 30, which are also generally parallel to each other and are spaced apart by a distance generally corresponding to the second dimension 18. The upper side 28 and the lower side 30 engage the first and second lateral sides 24, 26. The upper side 28 and the lower side 30 of the first-step cabinet portion 20 each have a forward edge 28*a*, 30*a* and a generally parallel rearward edge 28*b*, 30*b*.

The first-step cabinet portion 20 further includes a rear wall 32 joining the rearward edges 24*b*, 26*b* of the first lateral side 24 and the second lateral side 26 and the rearward edges 28*b*, 30*b* of the upper side 28 and the lower side 30 of the first-step cabinet portion 20 to form a unitary five sided cabinet. Preferably the depth of the first and second lateral sides 24 and 26 and the depth of the upper and lower sides 28 and 30 generally correspond to each other and to the depth of the cabinet space 12 typically about four inches. In this manner, the first step cabinet portion 20 is sized and shaped to fit within the cabinet space within the wall such that when the rear wall 32 abuts a wall at the back of the cabinet space, the forward edges 24*a*, 26*a*, 28*a*, 30*a* of the lateral sides 24 and 26 and the upper and lower sides 28 and 30 are generally aligned with the forward portion of the wall generally surrounding the cabinet space and form a first-step cabinet portion opening. Preferably at least a portion of the rear wall 32 is covered by a mirror 34.

The second-step cabinet portion 22 includes a first lateral side 36 and a second, opposite lateral side 38, the lateral sides 36, 38 being generally parallel to each other and being spaced apart by a distance greater than the first dimension 14. In the case where the first dimension 18 is about fourteen inches, the spacing between the first and second lateral sides 36, 38 of the second-step cabinet portion 22 is preferably about twenty inches but could be some other distance, if desired. The first lateral side 36 and the second lateral side 38 of the second-step cabinet portion 22 each have a forward edge 36*a*, 38*a* and a generally parallel rearward edge 36*b*, 38*b*.

The second-step cabinet portion 22 further includes an upper side 40 and a lower side 42, which are generally parallel to each other and are spaced apart by a distance greater than the second dimension 18. The upper and lower sides 40, 42 also engage the first and second lateral sides 36, 38. In the preferred embodiment, where the second dimension 18 of the cabinet space is about eighteen inches, the spacing between the upper and lower sides 40, 42 of the second-step cabinet portion 22 is about twenty-six inches. However, the distance and thus the height of the second-step cabinet portion 22 may vary depending upon the particular application. The upper side 40 and the lower side 42 of the second-step cabinet portion 22 each have a forward edge 40*a* 42*a* and a generally parallel rearward edge 40*b*, 42*b*. The distance between the forward edges 36*a*, 38*a*, 40*a*, 42*a* and the rearward edges 36*b*, 38*b*, 40*b*, 42*b* of the lateral sides 36, 38 and the upper and lower sides 40, 42 and thus the depth of the second-step cabinet portion 22 in the present embodiment is about 2½ inches. However, the depth of the second-step cabinet portion 22 could vary for particular applications.

Figure 2:
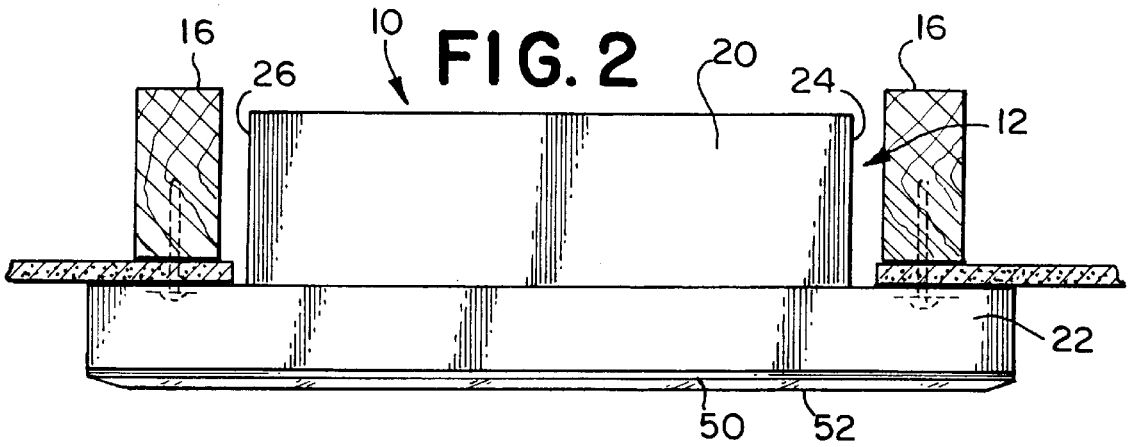
FIG. 2 is a sectional view of a portion of the two-stepped cabinet taken along line 2—2 of FIG. 1.

The second-step cabinet portion 22 further includes a rear wall 44 joining the rearward edges 36*b*, 38*b* of the first and second lateral sides 36, 38 and the rearward edges 40*b*, 42*b* of the upper and lower sides 40, 42 of the second-step cabinet portion 22. The rear wall 44 of the second-step cabinet portion 22 has a generally rectangular opening 46 extending therethrough. The opening 46 has a width generally corresponding to the first dimension 14, and a height generally corresponding to the second dimension 18 so that the opening 46 corresponds to the opening in the first-step cabinet portion 20 established by the forward edges 24*a*, 26*a*, 28*a*, 30*a* of the sides 24, 26, 28, 30, of the first-step cabinet portion 20. In addition, the rear wall 44 of the second-step cabinet portion 22 is integrally formed with the forward edges 24*a*, 26*a*, of the first and second lateral sides 24, 26 and the forward edges 28*a*, 30*a* of the upper and lower sides 28, 30 of the first-step cabinet portion 20. Preferably, the two-stepped cabinet 10 is formed of a polymeric material such that the first-step cabinet portion 20 and the second-step cabinet portion 22 are integrally molded or formed as a single unitary structure. As shown in FIG. 2, when the two-stepped cabinet 10 is installed in a cabinet space, the first-step cabinet portion 20 is located between the wall studs 16 and the second-step cabinet portion engages the wall surface outside of the cabinet space 12 to provide a finished appearance.

Suitable fasteners, such as wood screws extending into the studs 16 are employed to secure the two-step cabinet 10 in place. The forward edges 36*a*, 38*b* of the first and second lateral sides 36, 38 and the forward edges 40*a*, 42*a* of the upper and lower sides 40, 42 of the second-step cabinet portion 22 establish a generally rectangular forward opening 48 to the modular two-stepped cabinet 10. The two-stepped cabinet 10 further includes a door component 50 of a dimension to close the forward opening 48. The door component 50 is operatively attached along one side to the forward edge 38*a* of the second lateral side 38 of the second-step cabinet portion 22 by at least one hinge (not shown) and preferably two or more spaced hinges (not shown) in a manner well known in the art. The door component 50 demountably engages the forward edges 36*a*, 40*a*, 42*a* of the first lateral side 36 and the upper and lower sides 40, 42 of the second-step cabinet portion 22 by at least one closure or catch (not shown). The closure or catch may be a magnetic or mechanical catch of the type well known to those skilled in the art or may be omitted, if desired. Preferably, the door component 50 includes a mirrored surface 52 as at least the outer or exposed surface and may include a mirrored surface (not shown) as the interior surface.

The first-step cabinet portion 20 includes at least one repositionable shelf 54. Each of the first and second lateral sides 24, 26 of the first-step cabinet portion 20 includes a plurality of integral shelf supports in the form of generally aligned slot pairs 56 with each of the slots of each slot pair 56 having a thickness the same as or slightly thicker than the thickness of the shelf 54. The length of the shelf 54 is slightly less than the total distance from side to side between the base portion of the slots of each slot pair 56. In this manner, the shelf 54 is slidably received and fully supported within any one of the slot pairs 56. Preferably, the depth of the shelf 54 extends beyond the depth of the first-step cabinet portion 20 and preferably generally corresponds to the combined depth of the first and second-step cabinet portions 20, 22 so that when the shelf 54 is installed within one of the slot pairs 56 as illustrated, the front edge 54*a* of the shelf 54 is generally aligned with the front edges 36*a*, 38*a* of the lateral sides 36, 38 of the second-step cabinet portion 22. In this manner, large items such as rolls of toilet paper, large bottles, and the like may be stored within the cabinet 10. In the embodiment illustrated, four different slot pairs 56 at differing heights are provided for two shelves 54. However, it will be appreciated by those of ordinary skill in the art that a single shelf 54 or three or more shelves may be employed and that a greater or lesser number of slot pairs 56 may be employed. Further, in the illustrated embodiment, the shelf 54 is made of a generally transparent material, such as glass. However, the shelf 54 may alternatively be made of any other transparent or non-transparent generally rigid, lightweight material, such as a polymeric material or a metallic material, if desired.

Figure 3:
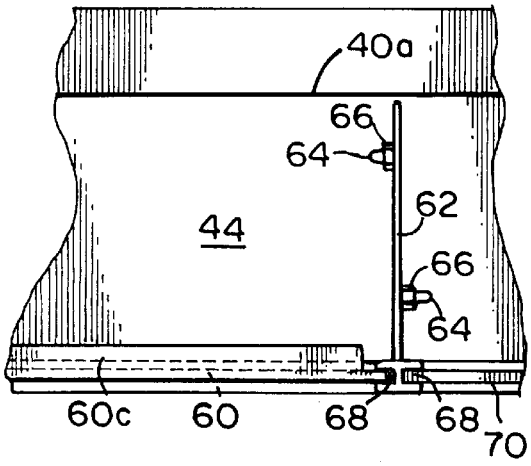
FIG. 3 is a sectional view of a portion of the two-stepped cabinet taken along line 3—3 of FIG. 1.
Figure 4:
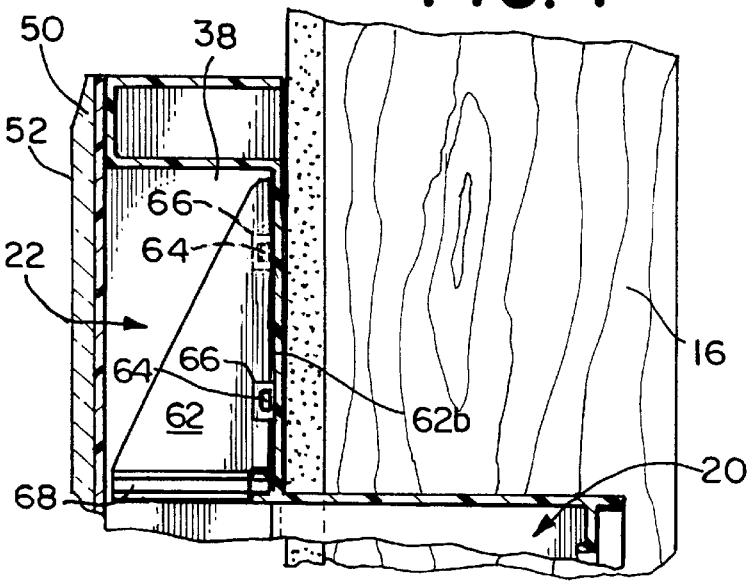
FIG. 4 is a sectional view of a portion of the two-stepped cabinet taken along line 4—4 of FIG. 1.

The second-step cabinet portion 22 also includes at least one removable shelf assembly 58. In the presently preferred embodiment, the shelf assembly 58 includes a pair of removable shelf members 60 and a separate, removable shelf support member 62. As best shown in FIGS. 1, 3 and 4, the shelf members 60, which preferably are made of a polymeric material, are generally flat and rectangularly shaped, having a length generally corresponding to about one-half of the overall width of the second-step cabinet portion 22 and having a width generally corresponding to the depth of the second-step cabinet portion 22. The outermost edge 60*a* of each of the shelf members 60 includes a generally upwardly extending ledge or lip 60*c* to help prevent small articles from rolling or falling off of the shelf members 60.

As best shown in FIGS. 1 and 4, the shelf support member 62, which also is preferably made of a polymeric material, is generally triangularly shaped. The rear edge 62*b* of the shelf support member 62 includes a pair of lugs 64 with each lug extending outwardly in an opposite direction from the other lug. The rear wall 32 of the second-step cabinet portion 22 includes a pair of generally rectangularly shaped keepers 66 which are sized and spaced to receive the lugs 64 of the shelf support member 62 for supporting the shelf support member 62 in the position as shown in FIG. 1. The lower end of the shelf support member 62 includes a pair of slots 68 on opposite sides thereof. Similar slots 70, 72 are located on the rear wall 44 and the lateral sides 36, 38 respectively of the second-step cabinet portion 22. When the shelf support member 62 is installed as shown in FIGS. 1, 3 and 4, the slots 68 on the shelf support member 62 align with the slots 70, 72 on the rear wall 44 and first and second lateral sides 36, 38 of the second-step cabinet portion 22 for receiving and retaining the rear edge 60*b* and the side edges of the shelf members 60 to thereby retain the shelf members 60 in place as shown. Preferably, the slots 70, 72 are preformed when the two-step cabinet 10 is fabricated. Of course, when the two-step cabinet 10 is installed as shown in FIG. 1, the lower side 42 of the second-step cabinet portion 22, as well as the lower side 30 of the first step cabinet portion 20 serve as additional shelves for supporting items within the two-cabinet 10.

Figure 5:
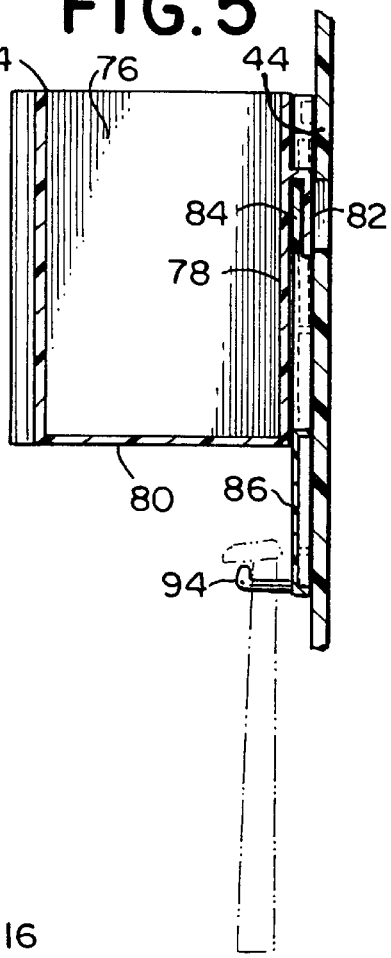
FIG. 5 is a sectional view of a portion of the two-stepped cabinet taken along line 5—5 of FIG. 1.

The two-step cabinet 10 further includes at least one and preferably two convenience cups 74 which may be employed for storing elongated items such as a toothbrush, hairbrush or the like. Each convenience cup 74 includes a body portion comprising a generally cylindrical wall 76, at least a portion of which 78 is generally flattened, and a closed bottom portion 80. Preferably, the top of the convenience cup is open, thereby defining a generally hollow interior portion having a depth suitable for holding articles. As best shown in FIGS. 1 and 5, an attachment member, in the present embodiment, a generally inverted L-shaped clip 82 extends outwardly from the flat portion 78 of the convenience cup 74. The attachment member or clip 82 is adapted for insertion into an integral support such as a generally rectangularly shaped keeper 84 extending from the rear wall 44 of the second-step cabinet portion 22 for locating and retaining the convenience cup 74 in place as illustrated. Preferably, the convenience cup 74 is also made of a polymeric material.

The two-step cabinet 10 further includes a spacing member 86 which may be employed to facilitate holding the convenience cup 74 firmly in place. The spacing member 86 which is generally flat and includes two leg members 88 is also preferably made of a polymeric material. Each of the leg members 88 includes a generally rectangularly shaped opening 90 which is adapted to receive therein a pair of elongated strips 92 extending outwardly from the rear flat portion 78 of the convenience cup 74. In this manner, the strips 92 extend into the openings 90 to help support the spacing member 86 when the convenience cup 74 is installed with the L-shaped clip 82 extending into the keeper 84 of the rear wall 44 of the second-step cabinet portion 22. As best shown in FIG. 5, the spacing member 86 extends below the bottom 80 of the convenience cup 74 and includes a pair of generally outwardly extending spaced apart post members or lugs 94. The distal ends of each of the lugs 94 extend slightly upwardly as shown in FIG. 5. The lugs 94 may be employed for holding elongated articles such as disposable shavers as illustrated. Preferably, the convenience cup 74 and the spacing member 86 are positioned as shown in FIG. 1 approximately midway between the upper side 40 and the lower side 42 of the second-step cabinet portion 22.

As illustrated in FIG. 1, the two-step cabinet 10, when installed in the cabinet space 12 as shown, has a door component 50 with hinges (not shown) along the left side (second lateral side 38 often second-step portion 22) so that the door 50 swings open or pivots from the left side of the cabinet 10. In some situations, it may be desirable to have the cabinet 10 open from the right side (not shown). In such situations, the cabinet 10 may be merely turned upside down (i.e., rotated 180 degrees) and installed with the door hinges toward the right side. In the case of such an installation, the shelf assembly 58 would be installed in the same manner utilizing the slots 70 and 72 and the keepers 66 which are located near the bottom of the two-step cabinet 10, i.e., near the lower side 42 of the second-step cabinet portion 22 in the present orientation. The convenience cups 74 and the spacing members 86 would likewise be installed in the opposite orientation.

From the foregoing description, it can be seen that the present invention comprises a unitary two-stepped cabinet which is adapted for installation within an opening in a wall and which provides enhanced cabinet storage. It will be recognized by those skilled in the art that changes may be made to the above-described embodiment of the invention without departing from the broad inventive concepts thereof. It is understood, therefore, that the invention is not limited to the particular embodiment and arrangement disclosed, but is intended to cover all modifications which are within the scope and spirit of the invention as defined by the appended claims.

What is claimed is:

1. A modular, two-stepped cabinet providing expanded storage capacity for use in a cabinet space in a wall, said cabinet space defined by a first dimension generally corresponding to the spacing between two adjacent studs in the wall, and a second dimension, said two-stepped cabinet being formed of a unitary one-piece molder body comprising:

a first-step cabinet portion including:

first and second lateral sides, spaced apart by a distance generally corresponding to said first dimension, each of said first and second lateral sides of said first-step cabinet portion having a forward edge and a rearward edge;

upper and lower sides, spaced apart by a distance generally corresponding to said second dimension, each of said upper and lower sides of said first-step cabinet portion having a forward edge and a rearward edge; and a rear wall joining said rearward edges of said first and second lateral sides and said rearward edges of said upper and lower sides of said first-step cabinet portion; and, a second-step cabinet portion including:

first and second lateral sides, spaced apart by a distance greater than said first dimension, each of said first and second lateral sides of said second-step cabinet portion having a forward edge and a rearward edge;

upper and lower sides, spaced apart by a distance greater than said second dimension, each of said upper and lower sides of said second-step cabinet portion having a forward edge and a rearward edge; and a rear wall joining said rearward edges of said first and second lateral sides and said rearward edges of said upper and lower sides of said second-step cabinet portion, said rear wall of said second-step cabinet portion having an opening extending therethrough, said opening having a width generally corresponding to said first dimension, and a height generally corresponding to said second dimension, said rear wall of said second-step cabinet portion integrally formed with said forward edges of said first and second lateral sides and said upper and lower sides of said first-step cabinet portion;

said forward edges of said first and second lateral sides and said forward edges of said upper and lower sides of said second-step cabinet portion establishing a forward opening to said modular two-stepped cabinet.

2. The modular, two-stepped cabinet of claim 1, wherein said first and second lateral sides of said first-step cabinet portion are further provided with a plurality of integral shelf supports.

3. The modular two-stepped cabinet of claim 2, further comprising at least one re-positionable shelf fitting between said first and second lateral sides of said first-step cabinet portion in engagement with at least one of said integral shelf supports of said first and second lateral sides of said first-step cabinet portion, said shelf being locatable between said upper and lower sides of said first-step cabinet portion and extending from a point proximate said rear wall of said first-step cabinet portion to a point proximate to said forward opening of the second-step cabinet.

4. The modular, two-stepped cabinet of claim 1, further comprising a plurality of integral shelf supports within said second-step cabinet portion and at least one shelf extending forward from a position proximate to said rear wall of said second-step cabinet portion to a position proximate to said forward opening.

5. The modular, two-stepped cabinet of claim 4, wherein said integral shelf supports permit repositioning of said shelf and said shelf is re-positionable.

6. The modular, two-stepped cabinet of claim 1, further comprising a door component of a dimension to close said forward opening of said modular two-stepped cabinet said door component being operatively attached to said forward edge of the first lateral side of said second-step cabinet portion by at least one hinge, and demountably engaging said forward edge of the second lateral side of said second-step cabinet portion by at least one closure.

7. The modular, two-stepped cabinet of claim 6, in which said cabinet may be turned top for bottom to provide a cabinet with said door opening to the opposite side.

8. The modular, two-stepped cabinet of claim 1 wherein said rear wall of said first-step cabinet portion is provided, at least in part, with a mirror surface.

9. The modular, two-stepped cabinet of claim 1, further comprising at least one integral support for the attachment of a convenience cup within said two-stepped cabinet.

10. The modular, two-stepped cabinet of claim 9, wherein said integral support for the attachment of a convenience cup is an opening.

11. A modular, two-stepped cabinet assembly providing expanded storage capacity for use in a cabinet space in a wall, said cabinet space defined by a first dimension generally corresponding to the spacing between two adjacent studs in the wall, and a second dimension, said two-stepped cabinet assembly being formed of:

a unitary body comprising:

a first-step cabinet portion including:

first and second lateral sides, spaced apart by a distance generally corresponding to said first dimension, each of said first and second lateral sides of said first-step cabinet portion having a forward edge, a rearward edge, and a plurality of integral shelf supports;

upper and lower sides, spaced apart by a distance generally corresponding to said second dimension, each of said upper and lower sides of said first-step cabinet portion having a forward edge and a rearward edge; and a rear wall joining said rearward edges of said first and second lateral sides and said rearward edges of said upper and lower sides of said first-step cabinet portion; and, a second-step cabinet portion including:

first and second lateral sides, spaced apart by a distance greater than said first dimension, each of said first and second lateral sides of said second-step cabinet portion having a forward edge and a rearward edge;

upper and lower sides, spaced apart by a distance greater than said second dimension, each of said upper and lower sides of said second-step cabinet portion having a forward edge and a rearward edge; and a rear wall joining said rearward edges of said first and second lateral sides and said rearward edges of said upper and lower sides of said second-step cabinet portion, said rear wall of said second-step cabinet portion having an opening extending therethrough, said opening having a width generally corresponding to said first dimension, and a height generally corresponding to said second dimension, said rear wall of said second-step cabinet portion integrally formed with said forward edges of said first and second lateral sides and said upper and lower sides of said first-step cabinet portion;

said forward edges of said first and second lateral sides and said forward edges of said upper and lower sides of said second-step cabinet portion establishing a forward opening to said unitary body;

a door component of a dimension to close said forward opening of said unitary body, said door component being operatively attached to said forward edge of the first lateral side of said second-step cabinet portion by at least one hinge, and demountably engaging said forward edge of the second lateral side of said second-step cabinet portion by at least one closure;

at least one re-positionable shelf fitting between said first and second lateral sides of said first-step cabinet portion, in engagement with at least one of said integral shelf supports of said first and second lateral sides of said first-step cabinet portion, said shelf being locatable between said upper and lower sides of said first-step cabinet portion and extending from a point proximate said rear wall of said first-step cabinet portion to a point proximate to said forward edges of said first and second lateral sides of said second-step cabinet portions;

at least one integral support for the attachment of a convenience cup within said cabinet assembly;

a convenience cup for holding articles within the cabinet assembly by attachment to said integral support, said convenience cup comprising:

a body portion comprising a generally cylindrical wall, at least a portion of which is generally flattened, a closed bottom portion, and an open top portion, defining a hollow interior portion, generally circular in cross-section, and having a depth suitable for holding articles;

an attachment member for the demountable attachment of said convenience cup to the integral support; and, an intermediate depending bracket member for hanging articles within the cabinet assembly, said bracket member comprising:

a depending portion extending below said closed bottom portion of said body portion of said convenience cup; and, at least one outwardly extending post member defining a structure for hanging articles below said convenience cup.

* * * * *